US007434689B2

(12) United States Patent
Homann

(10) Patent No.: US 7,434,689 B2
(45) Date of Patent: Oct. 14, 2008

(54) PACKING UNIT COMPRISING INTERCONNECTION MEANS

(75) Inventor: Sabine Homann, Bamberg (DE)

(73) Assignee: Mars Incorporated, McLean, VA (US)

( * ) Notice: Subject to any disclaimer, the term of this patent is extended or adjusted under 35 U.S.C. 154(b) by 683 days.

(21) Appl. No.: 10/501,702

(22) PCT Filed: Jan. 16, 2003

(86) PCT No.: PCT/EP03/00375

§ 371 (c)(1),
(2), (4) Date: Dec. 22, 2004

(87) PCT Pub. No.: WO03/059781

PCT Pub. Date: Jul. 24, 2003

(65) Prior Publication Data

US 2005/0115857 A1 Jun. 2, 2005

(30) Foreign Application Priority Data

Jan. 18, 2002 (DE) ..... 102 01 840

(51) Int. Cl.
*B65D 21/00* (2006.01)
*B65D 85/62* (2006.01)

(52) U.S. Cl. ..... 206/509

(58) Field of Classification Search ..... 220/4.21–4.24, 220/4.26; 206/508, 509, 519, 520
See application file for complete search history.

(56) References Cited

U.S. PATENT DOCUMENTS

| | | | | |
|---|---|---|---|---|
| 4,787,552 | A * | 11/1988 | Natori | 220/4.23 |
| 4,928,839 | A | 5/1990 | Kruelskie | |
| 5,220,999 | A * | 6/1993 | Goulette | 206/470 |
| 5,312,011 | A | 5/1994 | Fischer | |
| 5,890,595 | A | 4/1999 | Credle, Jr. | |
| 6,158,607 | A * | 12/2000 | Wallberg | 220/212 |

FOREIGN PATENT DOCUMENTS

| | | |
|---|---|---|
| GB | 1145924 | 3/1969 |
| WO | WO 02/28736 | 4/2002 |

* cited by examiner

*Primary Examiner*—Anthony D Stashick
*Assistant Examiner*—Harry A Grosso
(74) *Attorney, Agent, or Firm*—Fulbright & Jaworski LLP

(57) ABSTRACT

A packaging unit comprising a container body with a closed lower end, an open upper end and side walls between them; and a cap for closing the open end of the container body, which is pivotably attached thereto; wherein a floor section of the container body adjacent to the lower end thereof is designed such that said floor section can be inserted, to a predetermined extent, into the open end of another packaging unit, and means are provided for optionally alternatively connecting the floor section of the container body to the cap of another packaging unit.

8 Claims, 2 Drawing Sheets

PACKING UNIT COMPRISING INTERCONNECTION MEANS

CROSS-REFERENCE TO RELATED APPLICATIONS

This application is a national stage application of PCT/EP03/00375, filed Jan. 16, 2003, which claims priority to German Application No. 102 01 840.5, filed Jan. 18, 2002.

TECHNICAL FIELD

The invention relates to a novel packaging unit comprising a container body with a closed lower end and an open upper end with side walls between them, and a cap for closing the open end of the container body, which is pivotably attached thereto.

BACKGROUND OF THE INVENTION

Packaging units of this kind, mainly made from a plastic material, are known in the state of the art for packaging a wide variety of different products, including sweets.

Although the main purpose of such packaging units is to hold the goods concerned, products are also known on the market and from the state of the art which at the same time offer an additional benefit, namely in order to be used as an assembly construction kit for children. U.S. Pat. No. 5,447,249, for example, discloses containers with interlocking parts at the upper and lower ends of the container, which can be connected together. This kind of container, however, requires the possibility of undertaking considerations regarding the shape and/or appearance of the container, in order to provide the additional functionality, which increases the effort and expense involved in production, and the aesthetic appearance is impaired.

In some local markets, packaging units for sweets are sold which make it possible to connect the containers together so that they can be used as assembly construction kits for children once they have been emptied, and are provided with floor sections in two different shapes, one shape facilitating the insertion of the floor section into the open end of another container and the other shape making it possible to connect the floor section to the inside of the cap of another container. For this purpose, if it is intended to insert the floor section of the container into the open end of another container, the diameter of the floor section is reduced, but is provided, at the lower end, with an outwardly extending rim. Alternatively the diameter of the lower end is somewhat larger than the diameter of the rest of the container and is provided with a circular groove so that it fits over a corresponding circular rim on the inside of the cap. To illustrate this more clearly, drawings of such prior-art containers are provided in the attached FIGS. 1 and 2. The two types of container cannot be exchanged for one another in use, i.e. those containers whose floor sections fit into the open end of another container cannot be used to be connected to the cap of that container, whereas those containers whose floor sections are designed such that they can be connected to the inside of the cap, cannot be inserted into the open end of another container. The disadvantage of this system is that a consumer wishing to use the container as an assembly construction kit for children needs a sufficient number of both types of containers, in order for this additional benefit to be possible.

The problem underlying the present invention is therefore to provide a packaging unit of the above-mentioned type, offering complete flexibility in the use of the empty packaging units as assembly construction kits for children.

This object is achieved by a packaging unit of the above-mentioned type in which a floor section of the container body adjacent to the lower end thereof is designed such that said floor section can be inserted, to a predetermined extent, into the open end of another packaging unit, and means are provided for optionally alternatively connecting the floor section of the container body to the cap of another packaging unit.

BRIEF SUMMARY OF THE INVENTION

In a preferred embodiment, the cross-sectional area of the floor section of the container body is smaller than the cross-sectional area of the open end thereof, it being most preferred that a step is provided between the floor section and the rest of the side walls of the container body, in order to abut the upper edge of the open end of the container body of another packaging unit when the floor section is inserted therein.

At least a part of the means for connecting the floor section of the container body to the cap of another packaging unit is preferably provided in the lower end of the container body, said means most preferably comprising at least one indentation in the lower end of the container body in order to engage with at least one projection on the inside of the cap of another packaging unit.

In a most preferred embodiment, the container body possesses a circular cross-sectional area at least in the floor section and at the open end thereof.

Preferably, the packaging unit is manufactured from a plastic material, most preferably a polypropylene polymer.

In a preferred embodiment, the packaging unit is manufactured by injection moulding.

Designing the floor section of the container body in accordance with the invention so that it can be simultaneously inserted into the open end or alternatively attached to the cap of another container, preferably on the inside thereof, provides for the first time complete flexibility for making additional use of such a packaging unit as an assembly construction kit for children.

BRIEF DESCRIPTION OF THE DRAWINGS

Further advantages and details of the invention will become clearer when considering the following description of a specific embodiment, which is illustrated in the drawings.

DETAILED DESCRIPTION OF THE INVENTION

Figure 1:
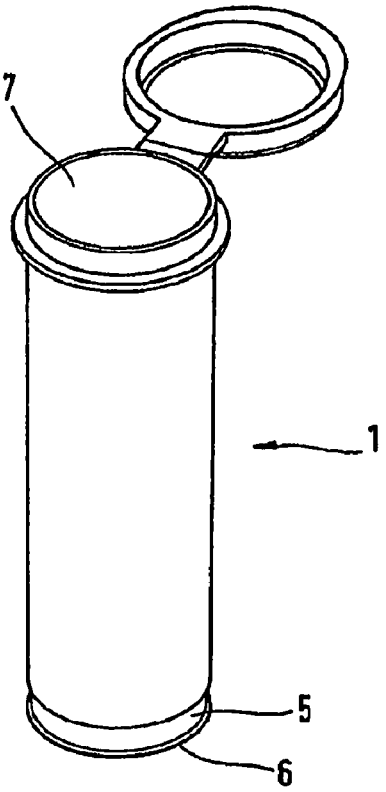
Fig. 1 Prior art
FIG. 1 is a side view of one embodiment of the prior-art container described above.

FIG. 1 illustrates an embodiment of the prior-art container 1 described above, which has a floor section 5 with a reduced diameter and, at the lower end thereof, an outwardly extending rim 6. This floor section 5 is designed such that it can be inserted into the open end 7 of another container, the rim 6 making a tight fit possible.

Figure 2:
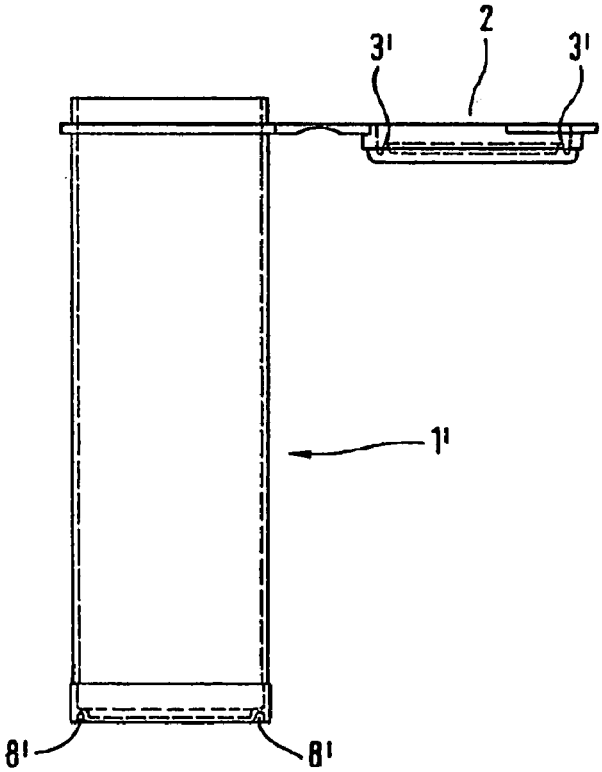
Fig. 2 Prior art
FIG. 2 is a perspective view of the other embodiment of the prior-art container described above.

A further embodiment of the prior-art container described above is illustrated in FIG. 2. This container 1' has a floor section 5' with a different shape, namely with a circular groove 8', so that it can be fitted over a corresponding prominent ring 3' on the inside of the cap 2.

Figure 3:
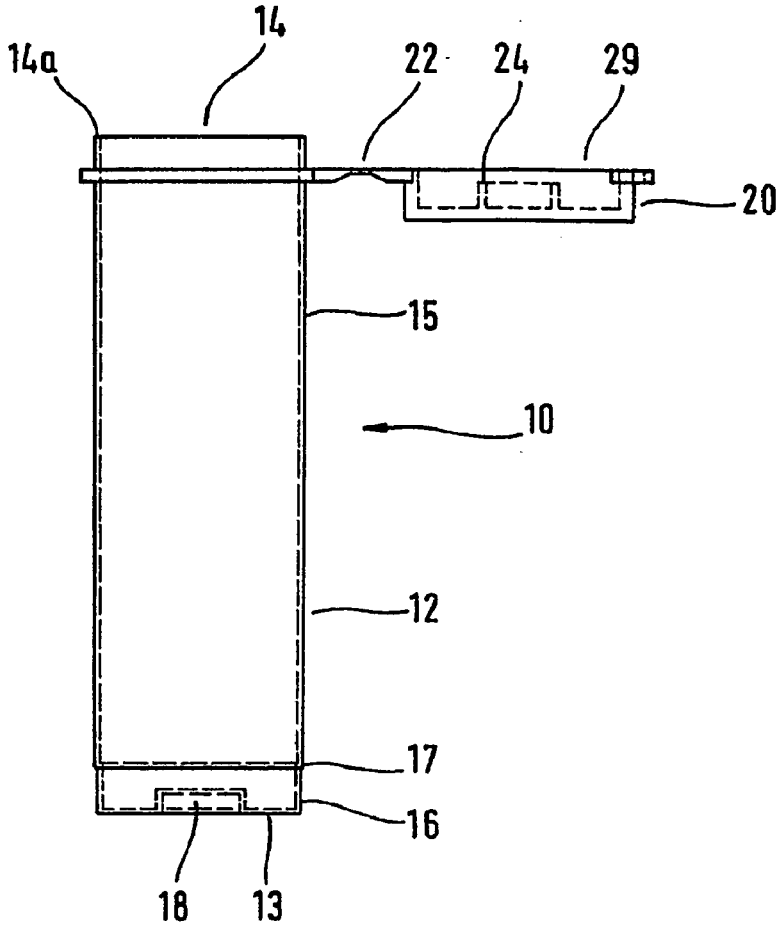
FIG. 3 is a side cross-section of a preferred embodiment of the container of the present invention.
Figure 4:
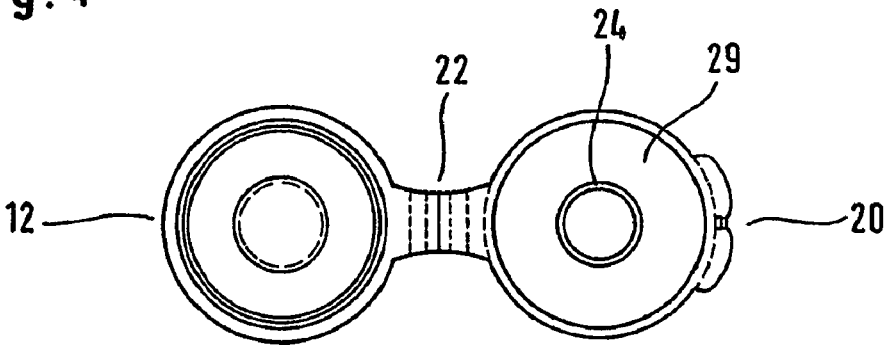
FIG. 4 is a plan view of the embodiment of FIG. 3.

In contrast to this system with reduced flexibility in use, a preferred embodiment of the packaging unit according to the present invention is illustrated in FIGS. 3 and 4. The packaging unit 10 comprises a container body 12 with a closed lower end 13 and an open upper end 14, and side walls 15 between them. Although the embodiment of FIGS. 3 and 4 is made cylindrical, the invention is not limited to such a shape. Instead, any other cross-sectional shape can be used, such as rectangular, square or some other polygonal shape.

A cap 20 is attached integrally to the container body 12 in order to close the open end 14 thereof. In the drawing, the packaging unit 10 is shown in an open position, i.e. the cap 20 has been removed from the open end 14. The cap 20 and container body 12 are connected via a flexible land 22, which could be of any shape and form and is not restricted to the form shown in the drawing.

A floor section 16 of the container body 12 is reduced in diameter, by 0.5 mm, for example, in order to enable this floor section to be insertable into the open end 14 of another container body 12. In order to limit the extent to which it can be inserted into the open end 14, a step 17 is provided in the preferred embodiment between the floor section 16 with the reduced diameter and the rest of the side walls 15 of the container body 12, so that said step abuts the upper edge 14 a of the open end 14 of the container body when the floor section 16 is inserted there.

In addition, an indentation 18 is provided in the lower end 13. This indentation 18 is dimensioned such that it fits tightly over a corresponding annular projection 24 which is provided on the inside 29 of the cap 20 of the packaging unit. The invention is not, however, limited to such a specific embodiment. Alternatively any other connection means can be provided in the floor section 16 of the container body 12 and/or on the cap 20, in order to make it possible to connect the packaging units together.

The system of the present invention is characterised by complete flexibility, since only one type of packaging unit is necessary to make it possible either to insert the floor section thereof into the open end of another packaging unit or, alternatively, to connect the floor section of the container body to the cap of another packaging unit. The system of the present invention therefore makes the packaging unit more flexible and attractive with regard to its additional use as an assembly construction kit for children.

Although the invention is not restricted to any specific material, suitable materials include plastic materials, such as thermoplastic materials, e.g. polypropylene or polyethylene. Preferably, the complete packaging unit is made from this plastic material and is manufactured using well-known and established techniques, such as injection moulding.

Injection moulding the plastic material also provides total flexibility with regard to the weight of the packaging unit, which ought to be a compromise between low weight and stability. Furthermore, injection moulding provides flexibility in determining the appropriate thickness of the side walls of the container, which, on the one hand, influences the weight of the container and, on the other hand, makes it possible to manufacture a container body with a certain flexibility when compressed, which in turn permits a kind of "self-opening" of the container. A "self-opening" of this kind is achieved by squeezing the container body, thus increasing the internal pressure such that the cap "flips open", without the need even to touch the cap.

Controlling the flexibility of the container body in this way by adjusting the thickness of its walls enhances the ease of using the packaging unit and increases its attractiveness, especially for children, because of the "flipping-open effect".

The features disclosed in the above description, in the claims and/or in the attached drawings can be essential to implementing the invention in its various forms both individually and in any combination.

What is claimed is:

1. A packaging unit comprising:

a container body with a closed lower end having a floor section adjacent the lower end, an open upper end and side walls between them; and a cap for closing the open end of the container body, pivotably attached thereto;

the floor section of the container body having an outer surface that is designed such that said floor section can be inserted, to a predetermined extent, into the cap of another packaging unit, and connection means are provided in the outer surface of the floor section of the container body and the cap in order to connect the packaging unit to another packaging unit, wherein an indentation in the outer surface of the floor section projecting into the intenior of the container body forms the connection means of the floor section of the container body.

2. The packaging unit as claimed in claim 1, wherein the cross-sectional area of the floor section of the container body is smaller than the cross-sectional area of the open end thereof.

3. The packaging unit as claimed in claim 2, wherein a step is provided between the floor section and the rest of the side walls of the container body, in order to abut the upper edge of the open end of the container body of another packaging unit when the floor section is inserted therein.

4. The packaging unit as claimed in claim 1, wherein said connection means of the cap comprises at least one projection on an inside surface of the cap that projects into the cap and engages at least one indentation in the lower end of the container body of another packaging unit in order to connect the packaging units together.

5. The packaging unit as claimed in any claim 1, wherein the container body possesses a circular cross-sectional area at least in the floor section and at the open end thereof.

6. The packaging unit as claimed in claim 1, wherein the packaging unit is manufactured from a plastic material.

7. The packaging unit as claimed in claim 6, wherein the plastic material is a polypropylene polymer.

8. The packaging unit as claimed in claim 6, wherein the packaging unit is manufactured by injection moulding.

* * * * *